US005231718A

United States Patent [19]

Blaha et al.

[11] Patent Number: 5,231,718

[45] Date of Patent: Aug. 3, 1993

[54] COMBINED CELLULAR MATERIAL AND INNERSPRING SUPPORT SYSTEM

[75] Inventors: Joseph W. Blaha, Pattersonville, N.Y.; Thomas S. Halliday, Needham, Mass.

[73] Assignee: Lumex, Inc., Bay Shore, N.Y.

[21] Appl. No.: 717,402

[22] Filed: Jun. 18, 1991

Related U.S. Application Data

[63] Continuation-in-part of Ser. No. 626,485, Dec. 12, 1990.

[51] Int. Cl.[5] ..... A47C 27/04

[52] U.S. Cl. ..... 5/475; 5/464; 5/450; 5/481

[58] Field of Search ..... 5/481, 450, 480, 464, 5/468, 477, 475

[56] References Cited

U.S. PATENT DOCUMENTS

| | | | |
|---|---|---|---|
| 2,193,410 | 3/1940 | Schubert | 5/464 |
| 2,425,728 | 8/1947 | Cobb | 5/464 |
| 2,446,775 | 8/1948 | Marsack | 5/477 |
| 3,246,443 | 4/1966 | Slemmons | 5/481 |
| 3,564,628 | 2/1971 | Oxford | 5/450 |
| 3,864,766 | 2/1975 | Prete | 5/450 |
| 4,928,337 | 5/1990 | Chauncey | 5/481 |

FOREIGN PATENT DOCUMENTS

| | | | |
|---|---|---|---|
| 555821 | 3/1957 | Belgium | 5/464 |
| 189485 | 11/1922 | United Kingdom | 5/475 |
| 215107 | 5/1924 | United Kingdom | 5/475 |
| 812786 | 4/1959 | United Kingdom | 5/475 |

*Primary Examiner*—Peter M. Cuomo
*Assistant Examiner*—Flemming Saether
*Attorney, Agent, or Firm*—Heslin & Rothenberg

[57] ABSTRACT

The invention provides a support system having an envelope of flexible material within which a flexible cellular support cell is positioned upon an innerspring support cell. The flexible cellular support cell may comprise a damped gas displacement support cell or a damped fluid displacement support cell, which may be surrounded by a relatively thick resilient material. The innerspring support cell may comprise a gatched pediatric innerspring. Various system embodiments are described and illustrated.

38 Claims, 8 Drawing Sheets

COMBINED CELLULAR MATERIAL AND INNERSPRING SUPPORT SYSTEM

The subject application is a continuation-in-part of U.S. Ser. No. 626,485, filed Dec. 12, 1990, the contents of which are hereby incorporated herein by reference.

BACKGROUND OF THE INVENTION

1. Technical Field

This invention relates to support systems, and more particularly, to systems comprising mattresses, cushions, upholstery padding and the like having a resilient cellular material therein positioned upon an innerspring support system.

2. Description of the Prior Art

Many support systems exist within the art which attempt to provide pressure relief for an individual. A trade-off typically occurs in all such systems between comfort, stability and weight in order to achieve a marketable device. For example, support systems which contain liquid, such as waterbeds and water filled cushions, have various support benefits which are well known. On the other hand, such systems also exhibit many disadvantages. In particular, conventional waterbeds and water filled cushions produce a kind of wave action or rolling motion when in use due to the tendency of water or other liquid inside the system to rush rapidly from one part thereof to another when an individual places his weight thereon, thereby forcing the liquid to flow to another part of the system. Moreover, since the envelope containing the liquid in such a system is typically elastically yieldable, a reaction to an initial liquid surge occurs. This reaction often results in a succession of countersurges within the envelope until the system reaches equilibrium. The described undamped surging and countersurging of the liquid in such systems is annoying to most users thereof. In order to obviate the above mentioned disadvantages, many waterbed manufacturers do not employ liquid displacement in that portion of the system which is intended to support the head and shoulders of the user. Instead, they employ a section of mattressing constructed in the conventional manner utilizing coil springs or other equivalent non-liquid structures. Obviously, this introduces an element of complexity to the manufacturing process and, as well, increased costs. Other manufacturers have attempted to dampen waterbed wave motion in various ways. In U.S. Pat. No. 3,585,356 solid particles, such as Styrofoam®, are disposed in liquid for this purpose. U.S. Pat. No. 3,736,604 uses flap means, as illustrated in FIG. 11 therein.

Saloff et al. describe in U.S. Pat. Nos. 4,942,634 and 4,370,768 (entitled "Damped Fluid Displacement Support System and Method for Making the Same" and "Damped Fluid Displacement Support System," respectively, both of which are assigned to the same assignee as the present invention; the contents of each of which are hereby incorporated herein by reference) substantially completely stable damped liquid displacement support systems. In these systems, a core of resilient liquid absorbent material is disposed within a liquid impervious sealed envelope, the core being saturated with a liquid. When force is applied to the system the liquid within the cell migrates from one portion thereof to another before coming to equilibrium about the applied force. The foam core prevents the liquid from rushing from one region where pressure is applied to another region in the support cell. Thus, movement of the fluid within the cell is "damped". Further, the amount of water available to be displaced within the cell is less than one would find in a conventional system and, therefore, the damped liquid system weighs less than a conventional system.

Notwithstanding the commercial success of this damped system, certain drawbacks inherent in the liquid construction remain. For example, although lighter than preexisting liquid support systems, the jell or water used therein necessarily makes the weight of the system a consideration for many individuals who may wish to own such a device Further, although better than conventional water support systems, a period of time is required before the damped liquid support system achieves equilibrium about an applied force, during which time there may be a feeling of instability in the individual using the system.

Non-liquid filled support systems, such as air filled mattress or cushion cells, are also typically unstable when pressure is applied thereto. In addition, such systems provide pressure relieving support characteristics generally inferior to those available with water filled systems.

Blaha describes in a copending, coassigned U.S. application, Ser. No. 626,485, filed Dec. 12, 1990 (entitled "Damped Air Displacement Support System") damped air displacement support systems. In these systems, a core of partially compressed, flexible cellular material is located within an envelope of flexible material. The compression of the core cellular material is sufficient to establish a partial vacuum within the envelope such that when force is applied to the cell the core instantly seeks equilibrium about that area of the envelope receiving the applied force. The core may be a partially compressed, resilient, gas-absorbent cellular material.

These damped air displacement support systems improve upon the comfort and stability, with less package weight, than preexisting body supporting techniques. The systems instantly contour to a body to provide pressure relief without jeopardizing stability.

While these damped air displacement support systems improve on preexisting support systems, intense efforts continue in this area for interface pressure reduction devices aimed at replacement of the more conventional bedding systems, such as box springs and mattresses. Although many of the preexisting devices have excellent properties, a key element often sacrificed is durability. To its advantage, the conventional innerspring system (for various patented innerspring systems, see Forster, U.S. Pat. No. 4,628,555, issued Dec. 16, 1986; Stumpf, U.S. Pat. No. 4,578,834, issued Apr. 1, 1986; Wagner, U.S. Pat. No. 4,535,978, issued Aug. 20, 1985; and Gurcew and Marcinczyk, U.S. Pat. No. 4,480,823, issued Nov. 6, 1984) has typically four to five times the life of current non-conventional mattress replacements. This relationship of durability can be directly related to cost and in many instances interferes with the sale of the product. Thus, a need exists in the marketplace for an innerspring pressure reducing device which achieves comfort, stability, and superior pressure relieving support, while still providing high durability.

SUMMARY OF THE INVENTION

Briefly summarized, the present invention comprises in one broad aspect a support system having an envelope of flexible material within which a flexible cellular support cell is positioned upon an innerspring support cell. An innerspring support cell best suited for this application is a gatched pediatric innerspring which is built in such a way that each innerspring is tied together to allow for contouring to the many positions of a hospital bed (referred to as "gatching"). This optimizes the qualities of the flexible cellular support cell by continuing the process of supporting the overall "smoothed" body shape.

The flexible cellular support cell provides immediate contouring of the body prominence before immersion into the innerspring support cell. This is fundamental in reducing the potential for pressure sores.

In one embodiment, the flexible cellular support cell comprises a damped gas displacement support cell. The damped gas displacement support cell comprises an envelope of flexible material within which a core of partially compressed, resilient gas-absorbent cellular material is located. A gas, such as air, is constrained within and partially fills the envelope.

In a further embodiment, the flexible cellular support cell comprises a damped fluid displacement support cell. The damped fluid displacement support cell comprises an envelope of flexible material within which a core of resilient fluid-absorbent material is located. A fluid, such as water or another fluid, substantially saturates the core.

In an enhanced version, the system embodiment further includes a relatively thick resilient material surrounding the envelope of the damped gas displacement support cell or the damped fluid displacement support cell. Further, and depending upon the implementation, a wall may be used to divide the interior of the envelope into multiple compartments, each compartment being occupied by the resilient gas-absorbent or fluid-absorbent cellular material. Again, depending upon the desired response characteristics, one or more openings in the divider wall may be provided for communication of constrained gas or fluid therebetween. Other specific enhancements are described and claimed herein.

The support system of the present invention described herein has a technological advantage over other support systems in that the pressure relieving device acts as an instantly contouring intermediate layer between the patient and innerspring. Pressure points are reduced by the device filling all unsupported areas and allowing the innerspring to support broad patient areas as presented by the top device. The present invention thus provides for patient comfort and durability, while still providing excellent interface pressure reduction.

BRIEF DESCRIPTION OF THE DRAWINGS

These and other objects, advantages and features of the present invention will be more fully understood from the following detailed description of certain embodiments thereof when considered in conjunction with the accompanying drawings in which.

DETAILED DESCRIPTION OF THE INVENTION

Figure 1:
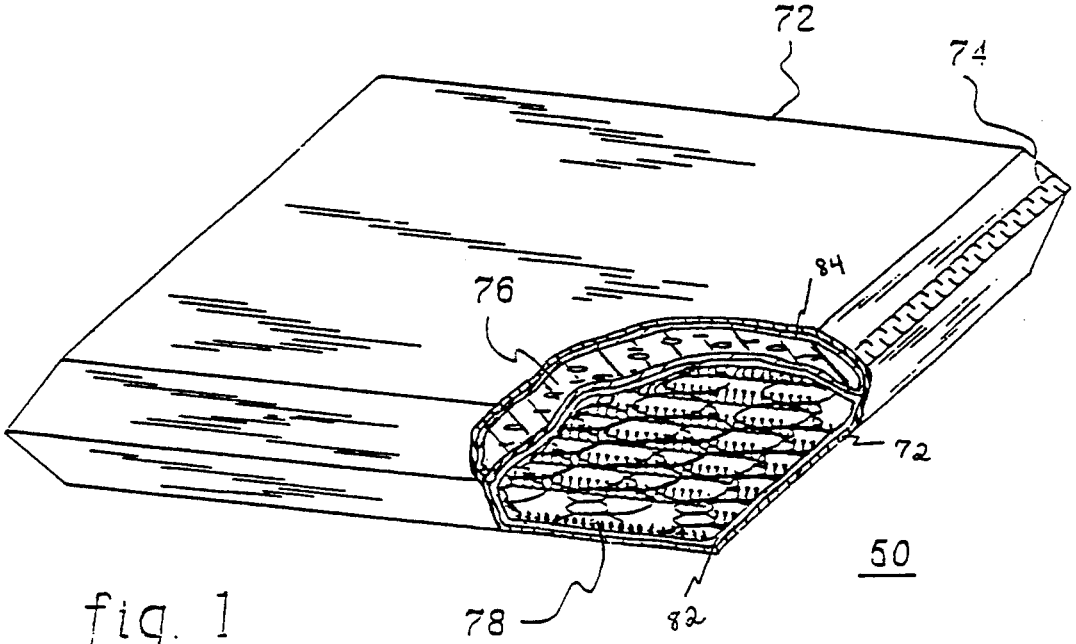
FIG. 1 is a partially cutaway perspective view of one embodiment of a support system pursuant to the present invention.

One basic embodiment of a combined innerspring and flexible cellular support system 50 pursuant to the present invention is shown in FIG. 1. System 50 includes a flexible envelope 72, preferably manufactured of vinyl, such as a high quality "waterbed grade vinyl". The vinyl has a thickness of about 0.020 inch and a cold crack resistance of at least about minus 20° C. Fahrenheit. The flexible envelope can easily be removed by use of the zipper 74 traversing three of the envelope's sides. The envelope surrounds a flexible cellular support cell 76 positioned upon an innerspring support cell 78.

Figure 1A:
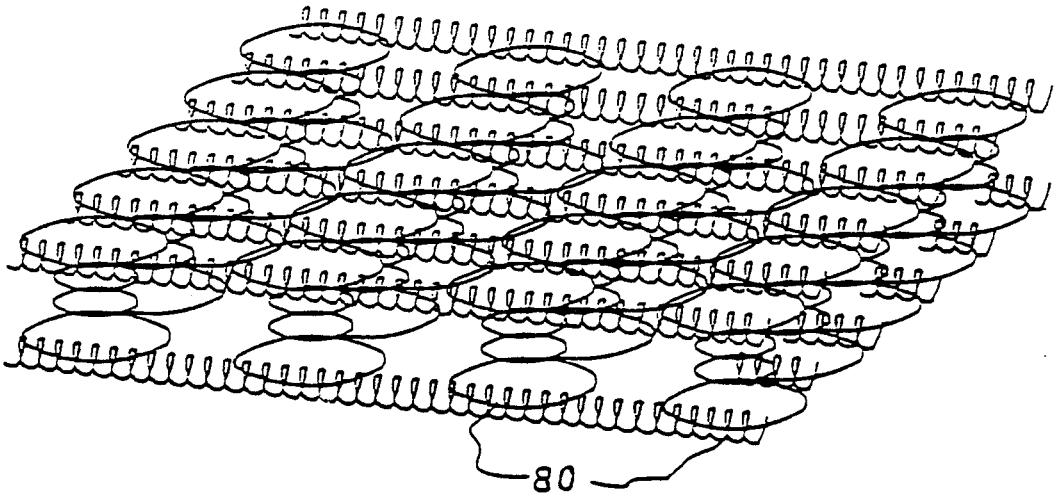
FIG. 1*a* is a perspective view of a gatched pediatric innerspring.
Figure 2:
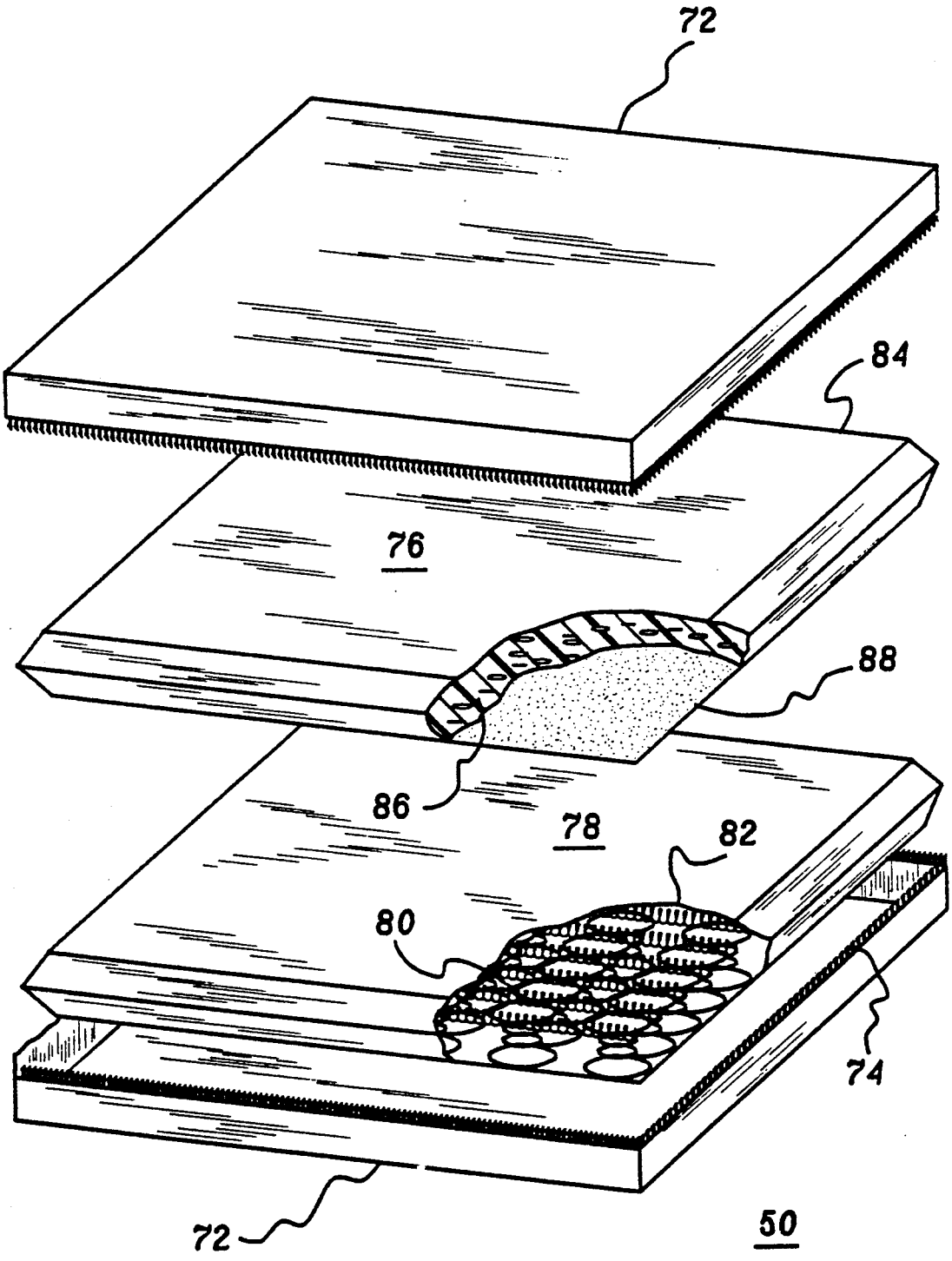
FIG. 2 is an exploded perspective view of one embodiment of a mattress assembly pursuant to the present invention which incorporates a damped gas displacement support cell of FIG. 3 or a damped fluid displacement support cell of FIG. 9 and a gatched, innerspring support cell.

As shown in further detail in FIG. 2, a suitable innerspring support cell 78 is a gatched pediatric innerspring. In a gatched pediatric innerspring (see FIG. 1*a*), each innerspring 80 is tied together to allow for contouring to the many positions of a hospital bed (referred to as gatching). The innerspring is surrounded by an envelope 82 of flexible material, such as the "waterbed grade vinyl" discussed above. Where gatching is not required, any other suitable innerspring unit can be used as the innerspring support cell of the present invention.

The flexible cellular support cell 76, in a basic embodiment as shown in FIG. 2, includes a flexible envelope 84 as discussed above surrounding a core 86 of material which occupies the space within the envelope. Suitable core materials include open celled foam or polyurethane.

The flexible cellular support cell 76 is positioned upon the innerspring support cell 78 and is held in its position by the flexible envelope 72. Where a more permanent positioning is required, a layer of vinyl 88 or other flexible material is adhesively attached to the bottom of the flexible cellular material, and the base of the vinyl or other flexible material is connected to the innerspring support cell.

In an enhanced embodiment of the present invention, the flexible cellular support cell 76 comprises a damped gas displacement support cell 10 or a damped fluid displacement support cell 11. Each of these displacement support cells is discussed in further detail below.

Figure 3:
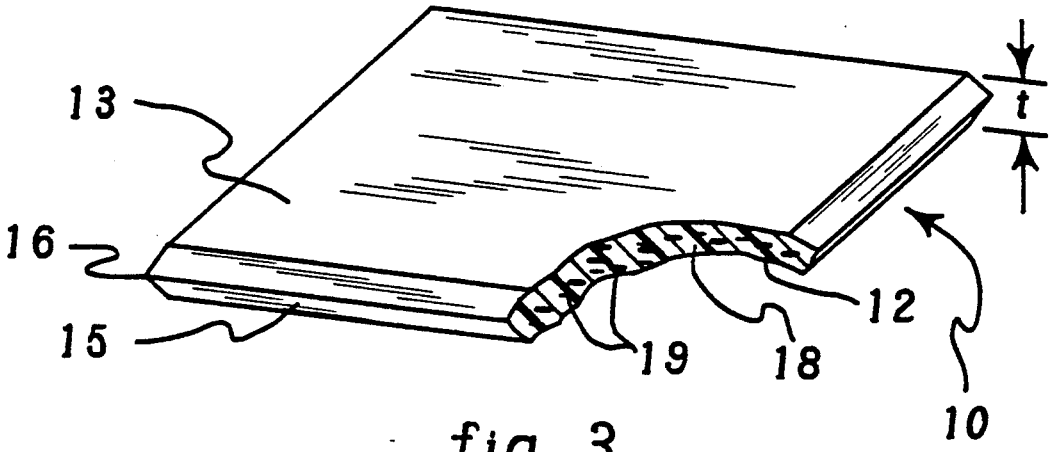
FIG. 3 is a partially cutaway perspective view of one embodiment of a damped gas displacement support cell pursuant to the present invention.

One basic embodiment of a damped gas displacement support cell 10 pursuant to the present invention is shown in FIG. 3. Cell 10 includes a flexible envelope 12 formed by heat sealing together upper and lower panels 13 & 15, respectively, along a circumferential seam 16. Envelope 12 comprises a gas impervious material such as a high quality "waterbed grade vinyl". The vinyl has a thickness of about 0.020 inch, and a cold crack resistance of at least about minus 20° Fahrenheit. Further, the vinyl has properties that permit panels 13 & 15 to be readily fused together by standard dielectric heating techniques.

A core of resilient, partially compressed, gas-absorbent cellular material 18 (e.g., polyurethane foam) occupies the space within envelope 12. Cellular material 18 is maintained in its partially compressed state by panels 13 & 15 of envelope 12. In effect, "extra" cellular material is positioned within the envelope. Material 18, which is preferably compressed in the range of 5 percent to 50 percent its normal dimensions, has a gas (or gaseous mixture such as air) constrained within a portion of its cellular structure, such as compressed cells 19.

The degree of material 18 compression depends upon desired support/response characteristics of the cell, along with characteristics of the particular cellular material used. For example, those skilled in the art will recognize that low density polyurethane foam, such as 1.2 lb. foam, requires greater compression than a medium density foam, e.g., 1.6 lb. foam, to produce the same support and response characteristics. Similarly, a medium density foam requires a greater percent compression than high density foam to produce comparable response characteristics. By way of example, if the desired thickness "t" of envelope 10 is approximately 1 inch, and a medium density cellular material, such as 1.6 lb. polyurethane foam, is used, then material 18 may have an uncompressed thickness of 1.25 inches, meaning the material is compressed roughly 25 percent when sealed within the envelope. The extent of compression may vary between implementations, but the concept of maintaining cellular material in a compressed state in the resultant structure is a significant feature of one embodiment of the present invention.

As noted, a gas or gas mixture such as air also occupies part of the space within envelope 12. For ease of cell manufacture air is presently preferred as the gas medium to be constrained within the open cellular structure of partially compressed material 18. Note that partial compression of material 18 typically produces a partial evacuation of air from certain cells of the open cellular structure. Thus, when force is applied to the support cell changing the envelope's configuration, these evacuated cells have the capacity to expand and accept air from other parts of the envelope. This transfer of air within the envelope occurs substantially instantaneously, at least in comparison with conventional liquid support systems. Further, the extra foam material within the envelope results in a much softer support system than preexisting support systems.

Figure 5:
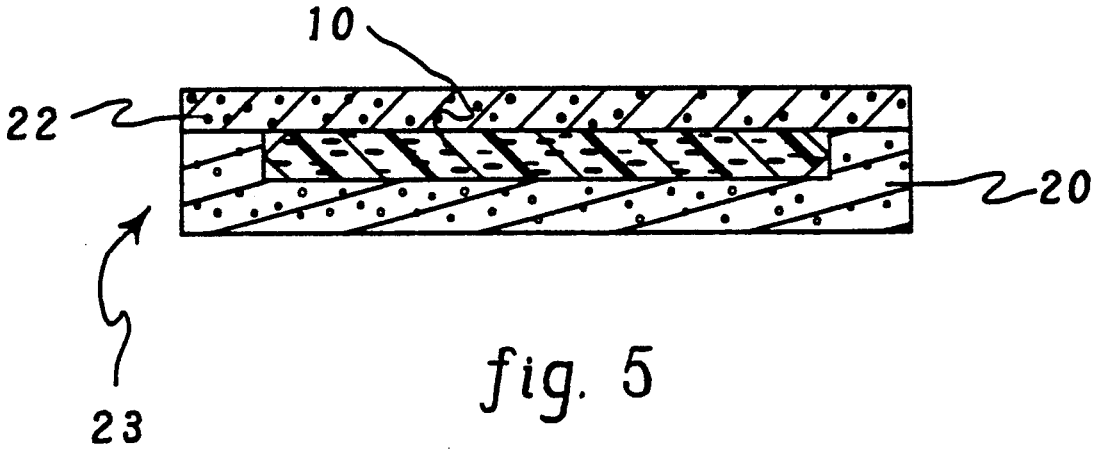
FIG. 5 is an assembled, cross-sectional view of the assembly of FIG. 4 taken along lines 3—3.
Figure 4:
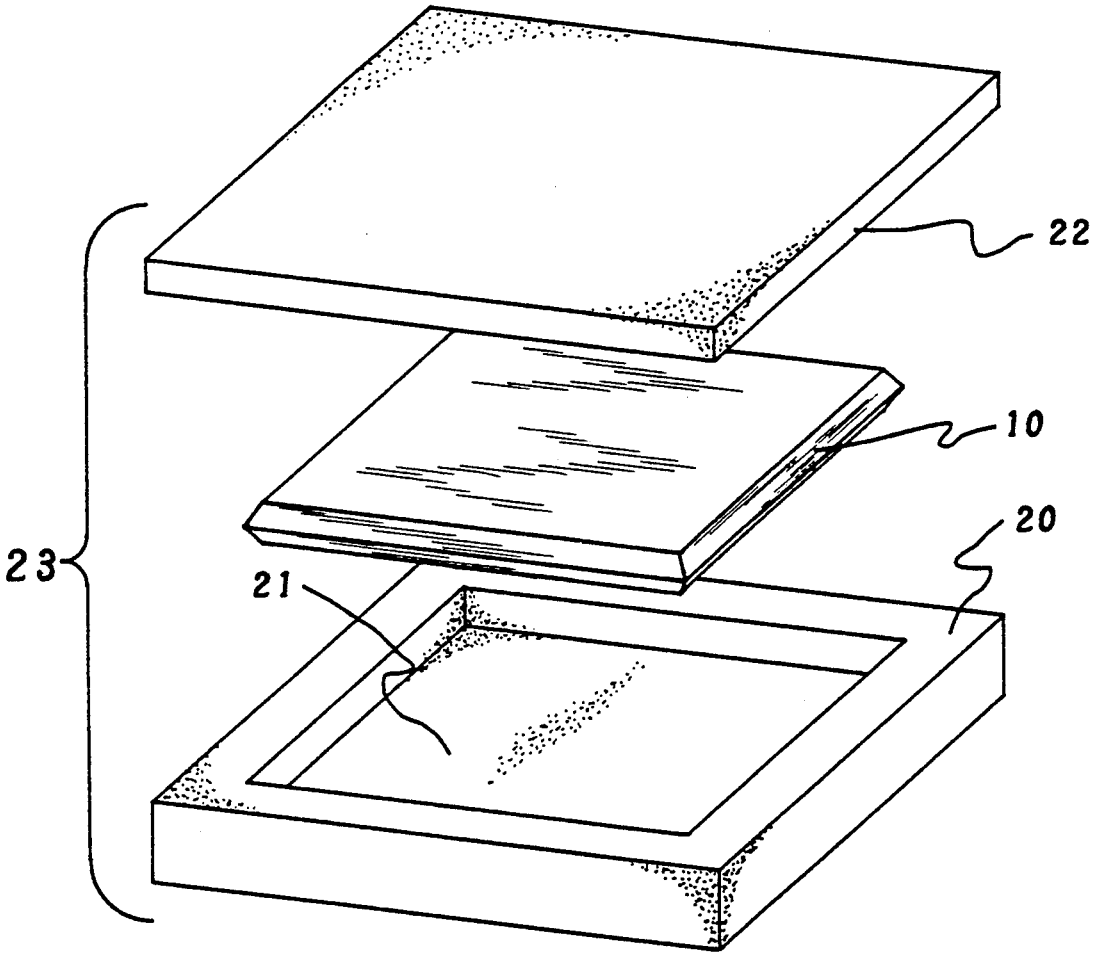
FIG. 4 is an exploded perspective view of one embodiment of a damped gas displacement support cell surrounded by a relatively thick casing of resilient material of the present invention.

One use for cell 10 is depicted in the cushion assembly 23 of FIGS. 4 & 5. In this embodiment, cell 10 is accommodated within an opening 21 defined in a base frame 20, and is retained therein by a top structure 22, which is preferably glued to base frame 20. Base 20 and top 22 are constructed of a resilient material, such as urethane foam of appropriate density. By way of example the base and top of cushion 23 may comprise 2.2 lb. and 1.9 lb. foam, respectively. This cushion structure is particularly useful as a base or back cushion for a conventional chair or for the base or back support surface of a wheelchair.

Figure 6:
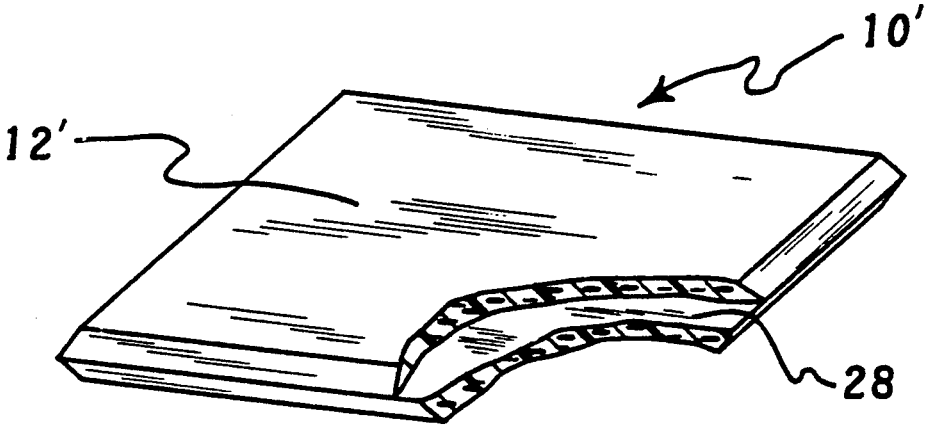
FIG. 6 is a partially cutaway perspective view of an alternate embodiment of a damped gas displacement support cell pursuant to the present invention.

Alternate embodiments of the damped gas displacement cell of the present invention may also be constructed. For example, in the cell 10' embodiment depicted in FIG. 6, a core divider 28 positioned substantially parallel to the upper and lower panels of envelope 12' is provided. In this embodiment, divider 28 functions to further throttle the flow of gas and the reconfiguration of material within the cell, i.e., in response to an applied force, by dividing the core into multiple compartments. If desired, one or more openings, for example peripherally located openinqs (not shown), may be provided in divider 28 to allow the communication of gas constrained within the different cell compartments to communicate therebetween.

Figure 7:
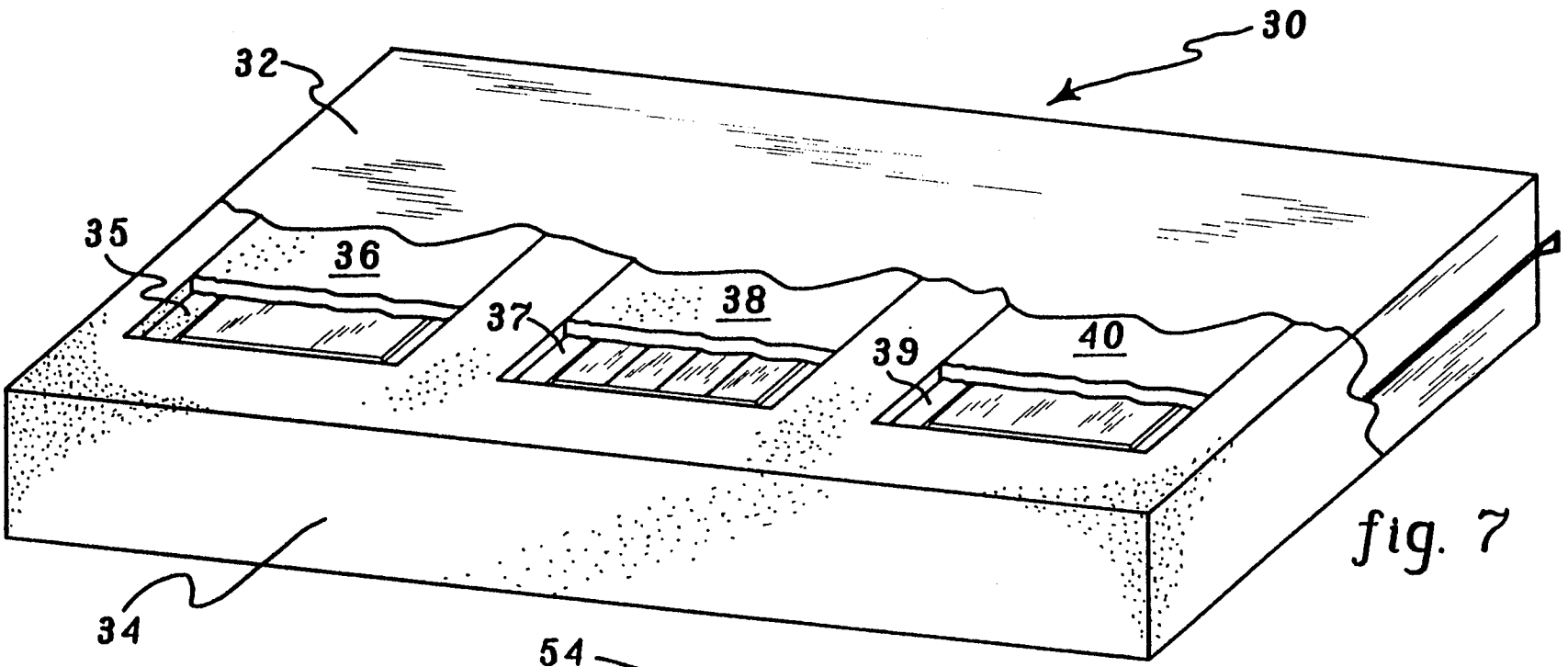
FIG. 7 is a partial cutaway perspective view of one embodiment including multiple damped gas displacement support cells pursuant to the present invention.

FIG. 7 depicts one configuration of the present invention useful as a mattress 30. Mattress 30 has a casing 32 manufactured of any suitable material generally used for mattresses. The material must be soft and have enough stretchability so as not to restrict the action of the invention as described herein. Preferably, a zipper 31 is provided to facilitate removal of casing 32 from mattress 30 for cleaning or replacement.

In the embodiment shown, a flexible foam frame structure 34 (e.g., 1.9–2.2 lb. polyurethane foam) defines three similar sized openings 35, 37 & 39 which accommodate cushions assemblies 36, 38 & 40, respectively. As with the cushion embodiment of FIGS. 4 & 5, each cushion assembly 36, 38 & 40 includes a foam frame having a base and a top, along with an inner cell manufactured pursuant to the present invention. Depending on the mattress size desired, e.g., twin vs. king size, mattress 30, cover 32 and frame 34 may be configured to accommodate one, or two or more side by side positioned cushion assemblies 36, 38 & 40. Assemblies 36, 38 & 40 are each dimensioned to fit within the corresponding openings 35, 37 & 39, respectively, provided within frame 34.

Multiple cell compartments are desirable when the size of the cell becomes relatively large, for example, twenty inches or more in width "x" and/or length "y". This prevents the undue collection of gas (air) and/or material (foam) in any one portion of the cell when a force is applied to another part thereof.

Figure 8:
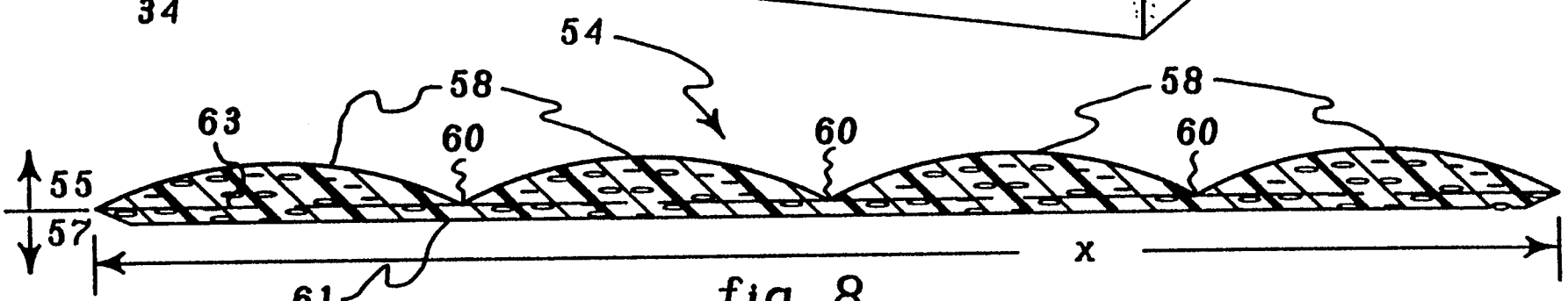
FIG. 8 is a cross-sectional view of one embodiment of a damped gas displacement support cell of the present invention.

As best shown in FIG. 8, cell 54 may be divided into an upper section 55 and a lower section 57. Section 55 is further divided into a plurality of compartments 58 by transverse seams and longitudinal seams 60. In one preferred embodiment, lower section 57 comprises one large compartment of width "x" (FIG. 8) and length "y" (not shown), and having a relatively high density cellular material therein in a compressed state. As a specific example, for a twin size mattress, dimensions x and y may be 23 and 29 inches, respectively; and the cellular material positioned in lower section 57 may comprise 2.2 lb. foam. The high density foam is maintained compressed in cell 54 by lower panel 61 and an interior divider 63 (FIG. 8) between which the foam is positioned. The multiple compartments of upper section 55 each include a medium density cellular material, which again pursuant to the invention is in a partially compressed state and partially evacuated of air or other gas constrained therein.

Although each of these embodiments of the damped gas displacement support cell of the present invention can be used in their own right as a cushion or mattress, the present invention provides for their use with an innerspring support cell as shown in FIGS. 1 and 2.

Figure 9:
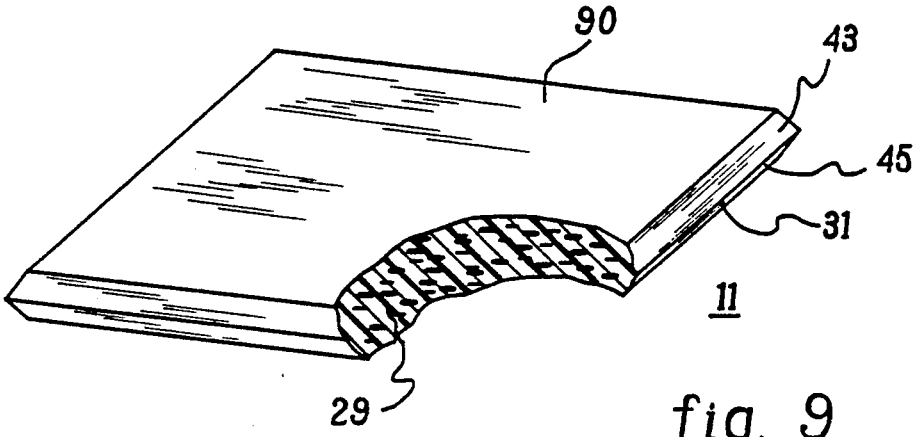
FIG. 9 is a partial cutaway perspective view of one embodiment of a damped fluid displacement support cell pursuant to the present invention.

Referring now to FIG. 9 there is shown a damped fluid displacement support cell 11 according to the invention comprising a fluid impervious envelope 90, including panels or sides 43 and 45. The envelope is preferably made of a high quality "waterbed grade vinyl" and has a thickness of about 0.020 inch, being free of pinholes and having a cold crack resistance of at least about minus 20° F. (Ca 30° C.) and which has properties that permit the panels or sides from which it is constructed to be readily fused together at seam 31 by standard dielectric heating techniques. A core 29 of resilient fluid-absorbent material occupies substantially all of the space within the envelope 90.

Figure 10:
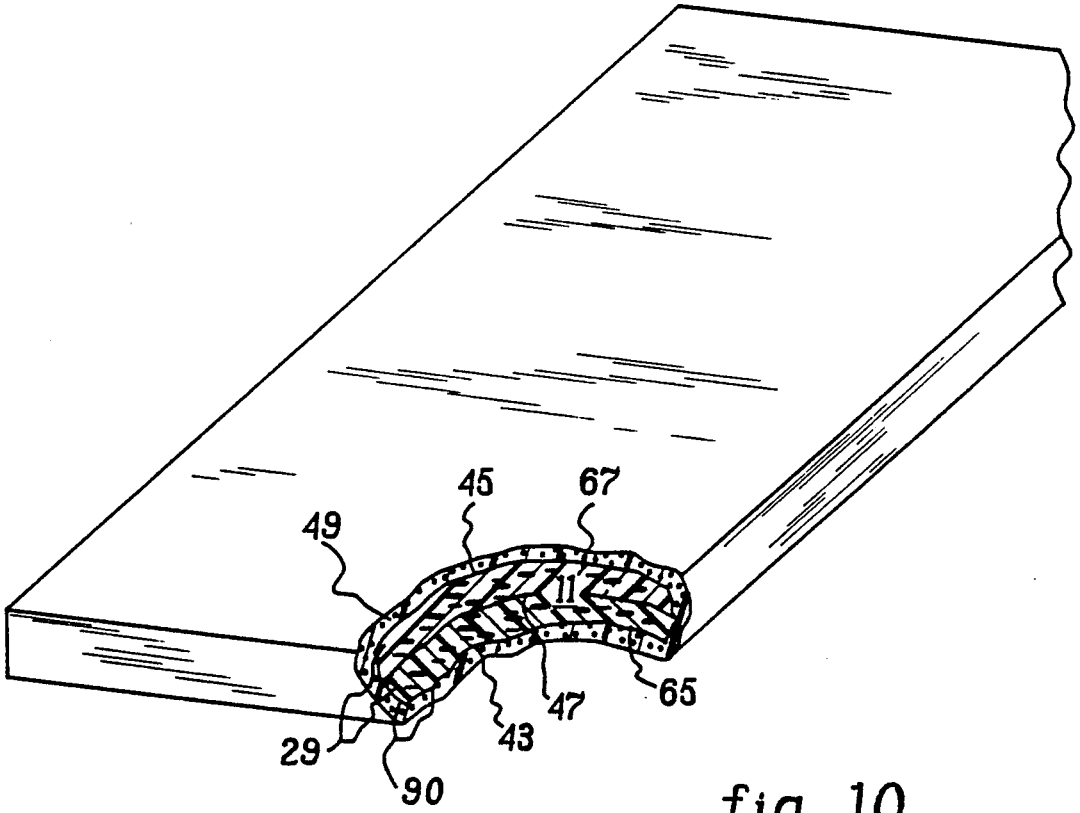
FIG. 10 is a partial cutaway perspective view of one embodiment of a damped fluid displacement support cell pursuant to the present invention surrounded by a relatively thick casing of resilient material.

Referring now to FIG. 10 such a damped fluid displacement support cell 11 is shown in a configuration which would be useful as a mattress. A suitable outer casing 49 of resilient material which exhibits good thermal insulating properties surrounds the envelope 90 of the cell 11. Urethane foam is very suitable for this purpose. Although not shown, it will be appreciated that casing 49 may be covered with any suitable covering material generally used for mattresses so long as it is sufficiently soft and has enough stretchability so as not to restrict the action of the system described hereinabove. The casing 49 is provided with a suitable cavity to accept the cell 11 and may be fabricated in halves in order to facilitate the assembly of the system. In a preferred embodiment of this invention, a suitable glue is employed to adhere the envelope of the cell 11 to the inner surface of the casing 49. The glue should be of a type suitable for bonding a vinyl to foam such as Scotch-Grip Brand Adhesive Number 1099L, manufactured by the 3-M Company. The bonding of the envelope 90 of cell 11 to the casing in this manner serves to keep it in place during its shipment or manipulation. It also further aids in resisting or reinforcing against the natural tendency of the cell to bulge near the bottom when it is stood on end, although in this latter respect the cell is substantially completely stable and free of bulging as described above.

As previously mentioned, a fluid such as water or other suitable liquid or fluid substantially saturates the core in a damped fluid or liquid displacement support cell in accordance with this invention. Water is the preferred fluid employed in the practice of the invention. In this respect, however, since the inventive system in actual use may be subject to relatively low temperatures and temperatures even as low as subzero temperatures, it is preferred that the water be employed with additives which lower its freezing point. A particularly preferred fluid which may be employed in the practice of this invention is, therefore, a fluid comprising 20 percent propylene glycol, 4 percent Natrosol, and further additives, the remainder being water. Such a mixture is not affected by great temperature changes and the presence of the propylene glycol acts as an antifreeze. In addition, propylene glycol and Natrosol provide a further advantage in that they increase the viscosity of the fluid, such as water, thereby effecting further control over the movement of the fluid and obviating a tendency for a certain amount of the fluid to always remain in the most compressed area or areas of the cell. This further improves the stabilizing, supportive, controlled nature of the flotation achieved by the system. Natrosol is a registered trademark of Hercules Powder Company, Wilmington, Del., U.S.A. for an alkali-soluble cellulose ether.

As also shown in FIG. 10, in one embodiment the cell 11 has an interior divider 47, made of the same or similar material as panels 43 and 45, which is disposed across the interior of the envelope 90 and separates it into two compartments 65 and 67. The interior divider may be provided with openings to permit communication between the compartments. While the openings in an interior divider employed in a system according to the invention are usually located at the corners when the system has a generally rectangular configuration, it is to be understood that they may be greater than four in number and are preferably located along or in the vicinity of the peripheral edges of the divider. For example, should the system have a circular configuration a plurality of such openings may be located around or in the vicinity of the circular periphery of the divider. While the shape of such openings is not critical, the size and location thereof provide highly beneficial effects in a damped fluid displacement support system according to the invention as explained more fully hereinafter.

A core 29 of resilient fluid-absorbent material occupies substantially all of the space within the compartments 65 and 67 of the envelope 90. A fluid, such as water or other suitable liquid, substantially saturating the core is also contained in the compartments of the envelope. The core 29 may be made of urethane foam or any other suitable resilient, fluid-absorbent material. Material such as urethane having a cellular structure is particularly useful because it will provide a desirable damping action. The resilient fluid-absorbent core 29 may be adhesively attached with a suitable adhesive, such as that described below, to the interior divider 47 only, on either one or both sides thereof, or to one or both panels 43 and 45 of the envelope as well, the adhesive being applied for this purpose to the panels on the sides thereof which serve as their internal surfaces. It will be appreciated that the panels of the envelope, as well as the interior divider which lies across the interior of the envelope in a coplanar relationship with respect to side panels 43 and 45 thereof, are of sufficient dimensions to accommodate the core in its fluid-saturated, expanded condition and to permit heat sealing of the panels and divider to each other along their peripheries.

Figure 11:
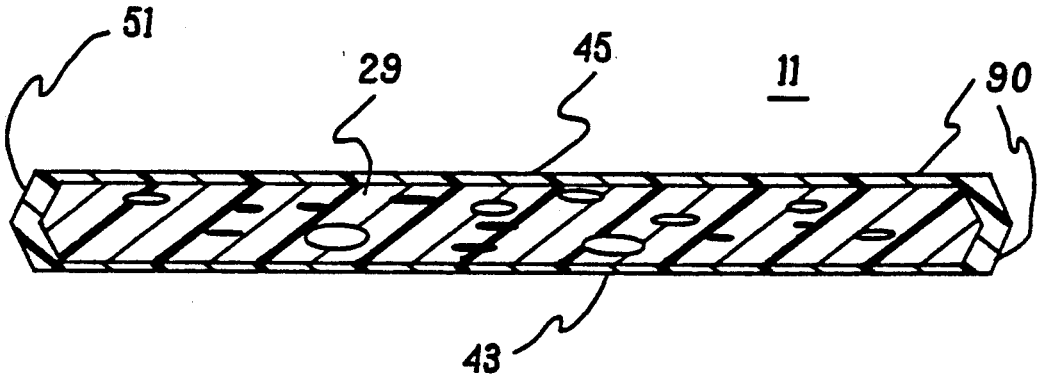
FIG. 11 is a partial elevational view in cross-section illustrating the configuration of a damped fluid displacement support cell pursuant to the present invention in a compressed and sealed state.
Figure 12:
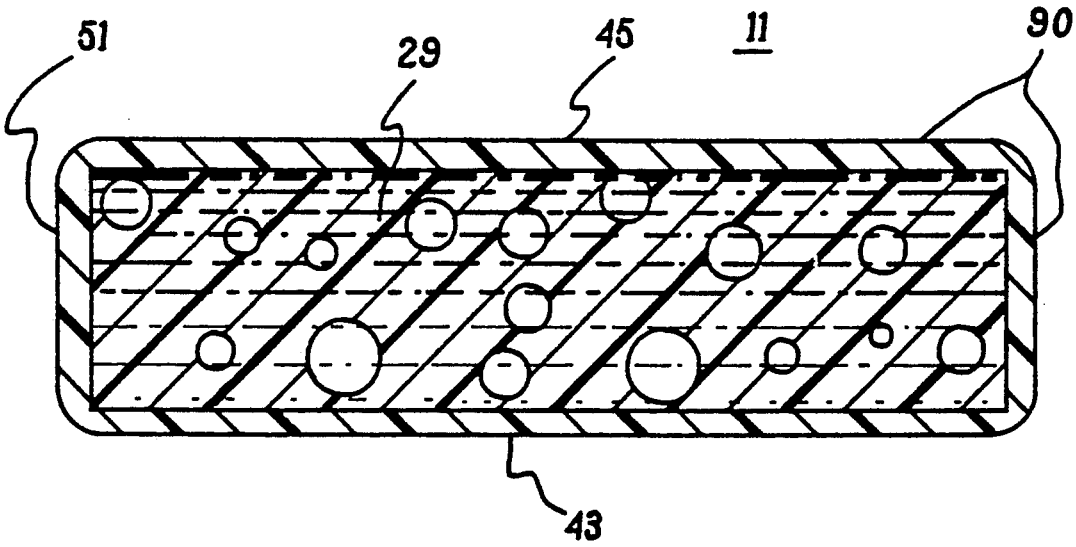
FIG. 12 is a partial elevational view in cross-section of the support cell illustrated in FIG. 11 after the core has been substantially saturated with a fluid.

Referring now to FIG. 11, a compressed and sealed damped fluid displacement support cell is shown. The flattened cell 11 consists of compressed core 29 in an envelope 90. The compressed cell is submerged in fluid or liquid, preferably water, and the fluid is permitted to enter the envelope causing expansion of the core 29 as shown in FIG. 12 until the core will absorb no more. In other words, the core is substantially saturated. It is to be noted that the vinyl material pieces are employed in a size sufficient to accommodate the expansion of the envelope. This extra material is shown as vertical wall section 51 in FIG. 12.

Each of these embodiments of the damped fluid displacement support cell, like the damped gas displacement support cell discussed above, can be used in their own right as a cushion or a mattress. However, the present invention provides for their use in combination with an innerspring support cell to form a mattress or a cushion, as shown in FIGS. 1 and 2.

Figure 13:
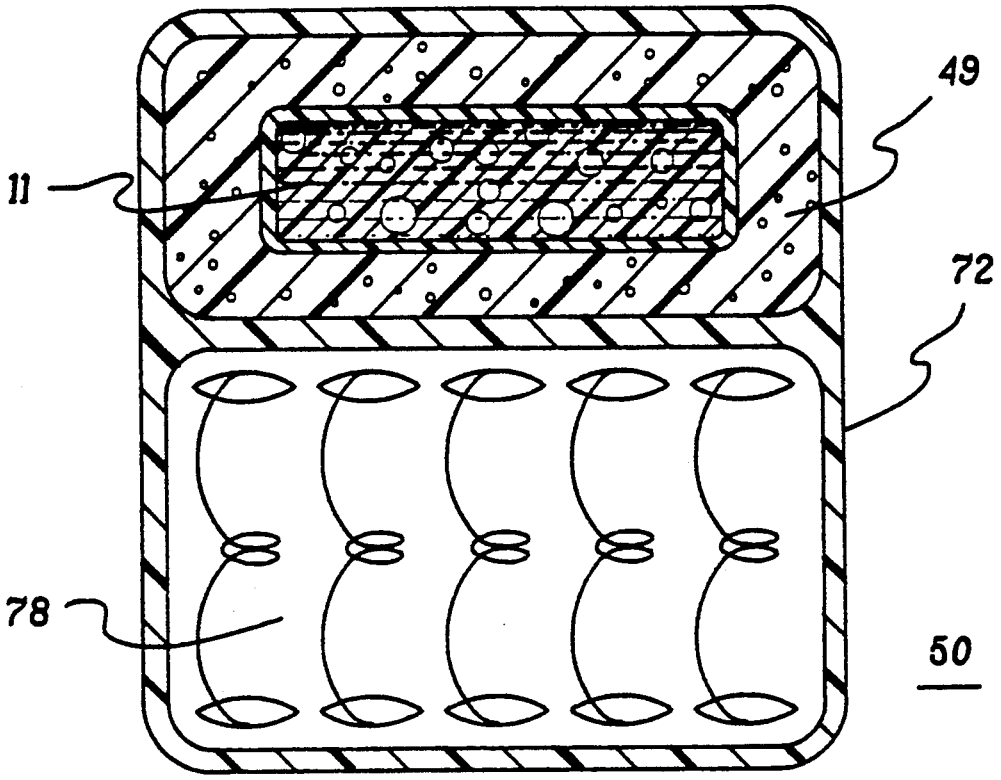
FIG. 13 is an assembled, cross-sectional view of a mattress assembly pursuant to the present invention which incorporates a relatively thick casing of resilient material surrounding the flexible cellular support cell.

Referring now to FIG. 13, an assembled combined innerspring and flexible cellular support system 50 of the present invention is shown. This embodiment includes a flexible envelope 72 surrounding an innerspring support system 78 and a damped fluid displacement support cell 11. The damped fluid displacement support cell is surrounded by a relatively thick casing of resilient material 49, such as polyurethane foam. The damped fluid displacement support cell could be replaced with a damped gas displacement support cell of the present invention.

Figure 14:
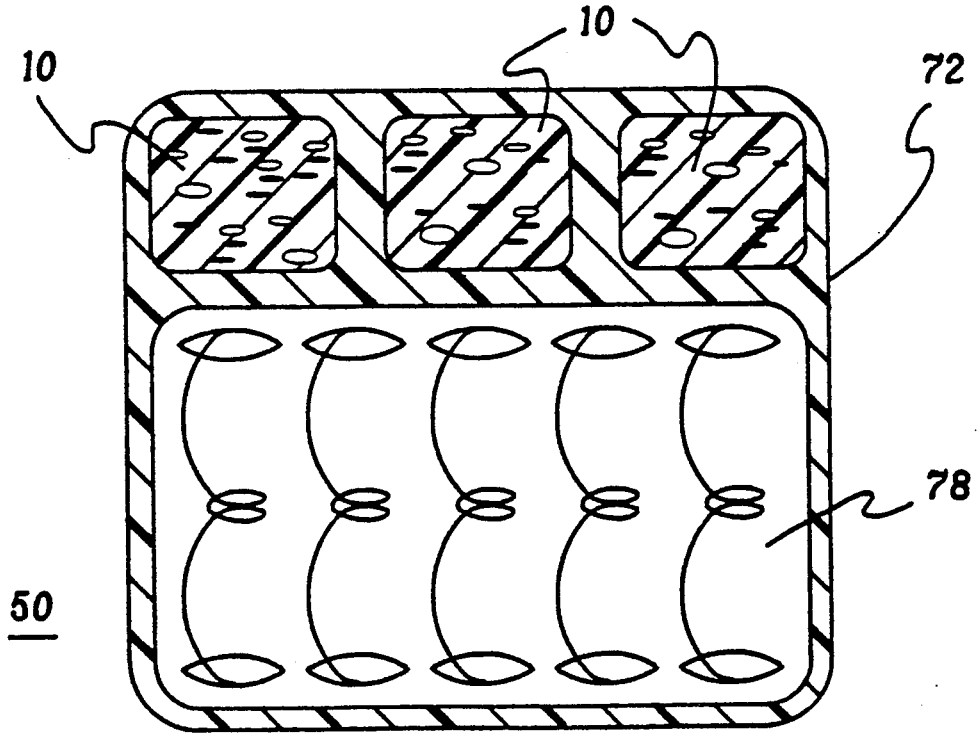
FIG. 14 is an assembled, cross-sectional view of a cushion assembly pursuant to the present invention which incorporates multiple damped gas displacement support cells of FIG. 3.

An additional embodiment of an assembled combined innerspring and flexible cellular support system 50 of the present invention, which could be a cushion or a mattress, is shown in FIG. 14. This embodiment includes a flexible envelope 72 and an innerspring support cell 78. The upper portion of the assembled system includes three damped gas displacement support cells 10 spaced longitudinally upon the innerspring support cell. As with the embodiment shown in FIG. 13, the damped gas displacement support cells 10 shown in FIG. 14 could be replaced with damped fluid displacement support cells. The multiple damped gas or fluid displacement support cells may be surrounded by an envelope of resilient material, similar to the embodiment shown in FIG. 7. The flexible foam frame 34 shown in FIG. 7 is optional.

The advantages of the combined innerspring/flexible cellular support system of the subject invention are readily apparent when the system of the subject invention is compared to conventional support systems, in regard to pressure relief for an individual. The following table presents data of a comparison of pressure sustained by an individual upon a conventional innerspring/mattress, foam mattress, water bed, damped fluid displacement support system, or the innerspring-/damped gas displacement system (damped air displacement) which is one embodiment of the subject invention.

| | Pressure (mm Hg) | | | | |
|---|---|---|---|---|---|
| Body Part | Conventional Innerspring/ Mattress | Foam | Water | DFD* | Innerspring/ DAD** |
| Hips (side lying) | 78 | 67 | *** | 46 | 52.0 |
| Upper back & shoulders | 31 | 27 | 25**** | 19 | 18.67 |
| Lower back & buttocks | 34 | 29 | 25**** | 21 | 34.0 |
| Head | *** | *** | *** | *** | 48.25 |
| Foot | *** | *** | *** | *** | 42.84 |

*DFD = Damped Fluid Displacement Support System
**DAD = Damped Air Displacement Support System
***data unavailable
****A leading waterbed industry publication cites 25-30 mm Hg pressure.

A comparison of the pressure values indicates that the innnerspring/damped gas (air) displacement support system which is one embodiment of the subject invention provides superior pressure relief when compared to a conventional innerspring/mattress system, while still providing the benefits of durability and cost efficiency of an innerspring pressure reducing device. Although the damped fluid displacement support system has comparable pressure values, the drawbacks discussed previously which are inherent in the liquid construction lead to the need for a system such as the innerspring/DFD or the innerspring/DAD system for pressure reduction.

Although certain preferred embodiments have been depicted and described in detail herein, it will be apparent to those skilled in the relevant art that various modifications, additions, substitutions and the like can be made without departing from the spirit of the invention, and these are therefor considered to be within the scope of the invention as defined by the appended claims.

What is claimed is:

1. A support system comprising:

an innerspring support cell;

a flexible cellular support cell positioned upon said innerspring support cell, said flexible cellular support cell comprising a first envelope of flexible material and a core of partially compressed, flexible cellular material occupying the space within said first envelope, wherein the interior of said first envelope is divided into multiple compartments by at least one divider wall, said compartments each being occupied by said partially compressed, flexible cellular material and said compartments communicating with each other through at least one opening in said at least one divider wall; and a second envelope of flexible material surrounding said innerspring and said flexible support cell.

2. The support system of claim 1 wherein said flexible cellular support cell comprises a damped gas displacement support cell.

3. The support system of claim 2 wherein said damped gas displacement support cell comprises:

a second envelope of flexible material;

a core of partially compressed, resilient gas-absorbent cellular material occupying the space within aid second envelope; and a gas constrained within and partially filling said gas-absorbent cellular material.

4. The support system of claim 3 wherein said gas-absorbent cellular material comprises open celled foam.

5. The support system of claim 3 wherein said gas-absorbent cellular material comprises cellular polyurethane.

6. The support system of claim 3 wherein said gas comprises air.

7. The support system of claim 3 wherein said second envelope of flexible material is manufactured of vinyl.

8. The support system of claim 3 wherein said second envelope comprises two substantially parallel panels of substantially the same size, each panel having a border surface, said border surfaces of said panels being sealed together in a gas impervious seam, one of said panels serving as a body supporting surface and said core being maintained partially compressed by the panels of said second envelope.

9. The support system of claim 3 further comprising a relatively thick casing of resilient material surrounding the second envelope.

10. The support system of claim 9 wherein the casing and the second envelope are adhesively attached to each other.

11. The support system of claim 1 wherein said flexible cellular support cell comprises multiple damped gas displacement support cells, the flexible cellular material of each of said damped gas displacement support cells comprising gas-absorbent cellular material having a gas constrained therein and partially filling said gas-absorbent cellular material.

12. The support system of claim 11 wherein said system includes three damped gas displacement support cells longitudinally spaced.

13. The support system of claim 11 wherein said multiple damped gas displacement support cells are surrounded by a third envelope of resilient material.

14. The support system of claim 11 wherein said damped fluid displacement support cell comprises:

a second envelope of flexible material;

a core of resilient fluid-absorbent material occupying substantially all of the space within the second envelope; and a fluid substantially saturating the core.

15. The support system of claim 14 wherein said fluid-absorbent material comprises cellular polyurethane.

16. The support system of claim 14 wherein said fluid is a fluid comprising by weight 20 percent propylene glycol, 4 percent alkali-soluble cellulose ether, and water.

17. The support system of claim 14 wherein said second envelope of flexible material is manufactured of vinyl.

18. The support system of claim 14 wherein said second envelope comprises two substantially parallel panels of substantially the same size, each panel having a border surface, said border surfaces of said panels being sealed together in a fluid impervious seam, one of said panels serving as a body supporting surface.

19. The support system of claim 18 wherein the interior of said second envelope is divided into multiple compartments by at least one divider wall, said compartments each being occupied by said core of resilient fluid-absorbent material and said fluid substantially saturating said core.

20. The support system of claim 14 further comprising a relatively thick casing of resilient material surrounding the second envelope.

21. The support system of claim 20 wherein the casing and the second envelope are adhesively attached to each other.

22. The support system of claim 1 wherein said flexible cellular support cell comprises a damped fluid displacement support cell.

23. The support system of claim 1 wherein said flexible cellular support cell comprises multiple damped fluid displacement support cells, the flexible cellular material of each of said damped fluid displacement support cells comprising fluid-absorbent cellular material substantially saturated with a fluid.

24. The support system of claim 23 wherein said system includes three damped fluid displacement support cells longitudinally spaced.

25. The support system of claim 23 wherein said multiple damped fluid displacement support cells are surrounded by a third envelope of resilient material.

26. The support system of claim 1 wherein said core of partially compressed, flexible cellular material comprises open celled foam.

27. The support system of claim 1 wherein said core of partially compressed, flexible cellular material comprises polyurethane.

28. The support system of claim 1 wherein said innerspring support cell comprises a gatched pediatric innerspring support cell.

29. The support system of claim 1 wherein said second envelope of flexible material is manufactured of vinyl.

30. The support system of claim 1 wherein said support system comprises a mattress.

31. The support system of claim 1 wherein said support system comprises a cushion.

32. The support system of claim 1 further comprising means for positioning said flexible cellular support cell upon said innerspring support cell.

33. The support system of claim 32 wherein said means for positioning comprises vinyl, said flexible support cell being adhesively attached to said vinyl and said vinyl being connected to said innerspring support cell.

34. The support system of claim 1 wherein said innerspring support cell is of substantially the same length and width as said flexible cellular support cell.

35. The support system of claim 34 wherein said innerspring support cell is about twice as thick as said flexible cellular support cell.

36. A support system comprising:

an innerspring support cell;

a damped gas displacement support cell positioned upon said innerspring support cell, said damped gas displacement support cell comprising a first envelope of flexible material and a core of partially compressed, resilient gas-absorbent cellular material occupying the space within said first envelope; and a second envelope of flexible material surrounding said innerspring and said damped gas displacement support cell;

wherein when no force is applied to said support system, said innerspring support cell exerts substantially no pressure on said damped gas displacement support cell;

wherein said second envelope comprises two substantially parallel panels of substantially the same size, each panel having a border surface, said border surfaces of said panels being sealed together in a gas impervious seam, one of said panels serving as a body supporting surface and said core being maintained partially compressed by the panels of said second envelope; and wherein the interior of said second envelope is divided into multiple compartments by at least one divider wall, said compartments each being occupied by said partially compressed, resilient cellular material and said gas constrained therein.

37. The support system of claim 36 wherein said compartments communicate with each other through at least one opening in said at least one divider wall.

38. The support system of claim 36 wherein at least one of said compartments is occupied with a compressed, resilient cellular material of different density than the density of the compressed, resilient cellular material in another one of said multiple compartments.

* * * * *

UNITED STATES PATENT AND TRADEMARK OFFICE

CERTIFICATE OF CORRECTION

PATENT NO. : 5,231,718

DATED : August 3, 1993

INVENTOR(S) : Joseph W. Blaha and Thomas S. Halliday

It is certified that error appears in the above-indentified patent and that said Letters Patent is hereby corrected as shown below:

In column 10, line 56, claim 3, change "aid" to --said--.

In column 11, line 28, claim 14, change "11" to --22--.

Signed and Sealed this

Twenty-ninth Day of March, 1994

*Attest:*

Bruce Lehman

BRUCE LEHMAN

*Attesting Officer*

*Commissioner of Patents and Trademarks*